United States Patent [19]

Matter et al.

[11] Patent Number: 5,040,973

[45] Date of Patent: Aug. 20, 1991

[54] ROTARY REACTOR AND LIFTER ASSEMBLY

[75] Inventors: Donald C. Matter, Nassau Bay; Harold L. Byerly, Houston; Bruno R. Kuhn, Nassau Bay; Richard N. Winders, La Porte, all of Tex.; Peter W. Falcone, Media, Pa.

[73] Assignee: Rollins Environmental Services (TX) Inc., Deer Park, Tex.

[21] Appl. No.: 519,085

[22] Filed: May 4, 1990

[51] Int. Cl.[5] ..... F27B 7/14

[52] U.S. Cl. ..... 432/103; 432/118

[58] Field of Search ..... 432/103, 118, 119

[56] References Cited

U.S. PATENT DOCUMENTS

| | | | |
|---|---|---|---|
| 2,104,040 | 1/1938 | Hurt . | |
| 3,445,099 | 5/1969 | Olsen et al. . | |
| 3,853,458 | 12/1974 | Wurr et al. | 432/118 |
| 3,869,247 | 3/1975 | Deussner | 432/118 |
| 4,066,024 | 1/1978 | O'Connor . | |
| 4,285,773 | 8/1981 | Taciuk . | |
| 4,569,659 | 2/1986 | Olsen et al. | 432/118 |
| 4,668,183 | 5/1987 | Patterson | 432/118 |

*Primary Examiner*—Henry C. Yuen

*Attorney, Agent, or Firm*—Thompson, Hine and Flory

[57] ABSTRACT

A rotary reactor of the type having a cylindrical, horizontally-oriented chamber lined with a refractory for burning materials therein and a plurality of trough-like lifters, extending along the interior surface of the chamber, for lifting and dumping sand in the chamber as the chamber rotates, a long-wearing lifter assemble which minimizes intrusion of contaminants between the lifter and the refractory. The lifter assembly comprises a bolt attaching the lifter to the chamber, a split support cylinder recessed into the refractory lining and coaxial with the bolt, a sleeve member, coaxial with the support cylinder, extend through the chamber and receiving the bolt, an anchor plate receiving the bolt and sleeve member therethrough and having an outer periphery contiguous with an inner periphery of the sleeve member, a mounting plate supported on the support cylinder and attached to the anchor plate supported on the support cylinder and attached to the anchor plate, a retainer plate attached to an inner surface of the lifter and receiving the bolt therethrough so that the bolt cams against the retainer plate, and a cap covering and protecting the bolt. In one embodiment, the assembly includes slots formed in the lifter and retainer plate to allow movement of the lifter relative to the bolt resulting from thermal expansion. A cam plate slidably mounted within the slots receives the bolt and a slide plate covers the slots and cam plates to prevent fouling of the slots.

26 Claims, 5 Drawing Sheets

ROTARY REACTOR AND LIFTER ASSEMBLY

BACKGROUND OF THE INVENTION

The present invention relates to rotary reactors and, more particularly, to rotary reactors utilizing sand or other granular materials as a vehicle to accelerate the heating of the constituents to be burned therein.

Reactors, which include incinerators and retorts, incorporate hot sand in order to convey heat energy to the material being burned within the reactor. Such material may vary from oil shale to hazardous waste material having organic components. In order to convey the heat energy from the sand to the material to be burned, it is desirable to intimately mix the material with heated sand. Accordingly, certain types of these reactors include a mechanically-activated, "fluidized" bed for mixing sand. The mechanical component comprises a plurality of lifters attached to the reactor wall for conveying sand from a lower portion of the reactor to an upper portion, then dumping the sand in cascade-fashion back to the lower portion. In cascading, the sand becomes heated by contact with the burner flame and heated air within the reactor, and further contacts the material to be burned.

An example of such a reactor is disclosed in Taciuk U.S. Pat. No. 4,285,773. That patent discloses a reactor for the recovery of bitumen from rocks or sands and includes a horizontal, rotary reactor chamber having both flat-faced and cup-faced lifters bolted to the inner surface of the reactor chamber.

Similarly, O'Connor U.S. Pat. No. 4,066,024 discloses a rotating fluidized bed combustor having a cylindrical drum fitted with a plurality of baffles which extend longitudinally along an inside surface of the drum and sweep through a sand bed, located in the bottom of the drum, as the drum rotates. The baffles lift the sand from the bed, then drop the sand through an open region of the drum as the baffles rotate over the bed.

Typically, the bolts attaching the lifters of such reactors extend through the refractory lining of the rotary chamber, the chamber wall itself, and include a threaded portion protruding from an outer surface of the chamber. The bolts include heads which cam against a wall of the lifter and are secured to the reactor chamber by nuts.

A disadvantage with this mounting method is that gaps form between the the lifters and the refractory wall and collect contaminants. The exceedingly high temperatures within the reactor, the corrosive atmosphere and the abrasive nature of the material within the reactor cause the lifters to become separated from the refractory lining and to warp. In addition, thermal expansion of the lifters, caused by the extreme changes in temperature occurring within the reactor, cause stresses to be applied against the mounting bolts. These factors operate to shorten the life of a particular lifter and its associated attachment assembly, requiring undesirable downtime of the reactor for maintenance and repair. Accordingly, there is a need for a lifter attachment assembly which is capable of withstanding the corrosive environment within the reactor and of accommodating the thermal stresses imposed on the lifter and lifter attachment assembly.

SUMMARY OF THE INVENTION

The present invention is a rotary reactor and lifter assembly which provides a level base, flush with the refractory lining, for receiving lifters to minimize the collection of contaminants between the lifters and refractory lining. Further, the lifter assembly compensates for thermal expansion and contraction of the lifters, thereby reducing thermal stresses which might otherwise be imposed upon the lifters and mounting bolts of a reactor.

In a preferred embodiment of the invention, the reactor includes a lifter assembly having a sleeve extending through the refractory lining and reactor wall and receiving the lifter attachment bolt therethrough, a split support cylinder, coaxial with the sleeve, set into the refractory lining, an anchor plate receiving the sleeve therethrough and mounted within the support cylinder, a mounting plate supported on the support cylinder and attached to the anchor plate and receiving the bolt therethrough and a retainer plate camming against the head of the bolt and attached to an inside wall of the lifter. A cap is attached to the retainer plate to protect the bolt head.

Also in the preferred embodiment, the reactor includes a lifter assembly having an elongate slot formed in the retainer plate and lifter wall which allows movement of the lifter relative to the bolt. A cam plate is slidably mounted within the slots and receives the bolt. In both embodiments, the support cylinder and centering plate are mounted within a recess formed in the refractory lining and retained therein by bedding refractory.

The recessed support cylinder is precisely located relative to the sleeve and attachment bolt so that the mounting plate it supports in turn supports the lifter at the proper angle relative to the attachment bolt. However, there is no welded or other non-yielding connection between the cylinder and plate to allow for differing amounts of thermal expansion between the two components.

Bedding refractory is used to set the support cylinder and centering plate within the refractory lining. In addition, bedding refractory is used along the lifter in order to eliminate gaps which might otherwise collect contaminants and force the lifter away from the refractory lining.

Accordingly, it is an object of the present invention to provide a reactor or the type having a mechanically-activated sand bed with lifters attached to the reactor by lifter assemblies which are resistant to the high temperatures and corrosive environment with the reactor so as to minimize reactor downtime for lifter maintenance; a lifter assembly in which the components are assembled to allow for differences in thermal expansion and contraction; a lifter assembly which minimizes the likelihood of accumulation of contaminants between the components of the lifter assembly as well as the lifter and the refractory lining; and a lifter assembly which is relatively simple to attach to and remove from the reactor wall.

Other objects and advantages of the present invention will be apparent from the following description, the accompanying drawings and the appended claims.

DETAILED DESCRIPTION

Figure 1:
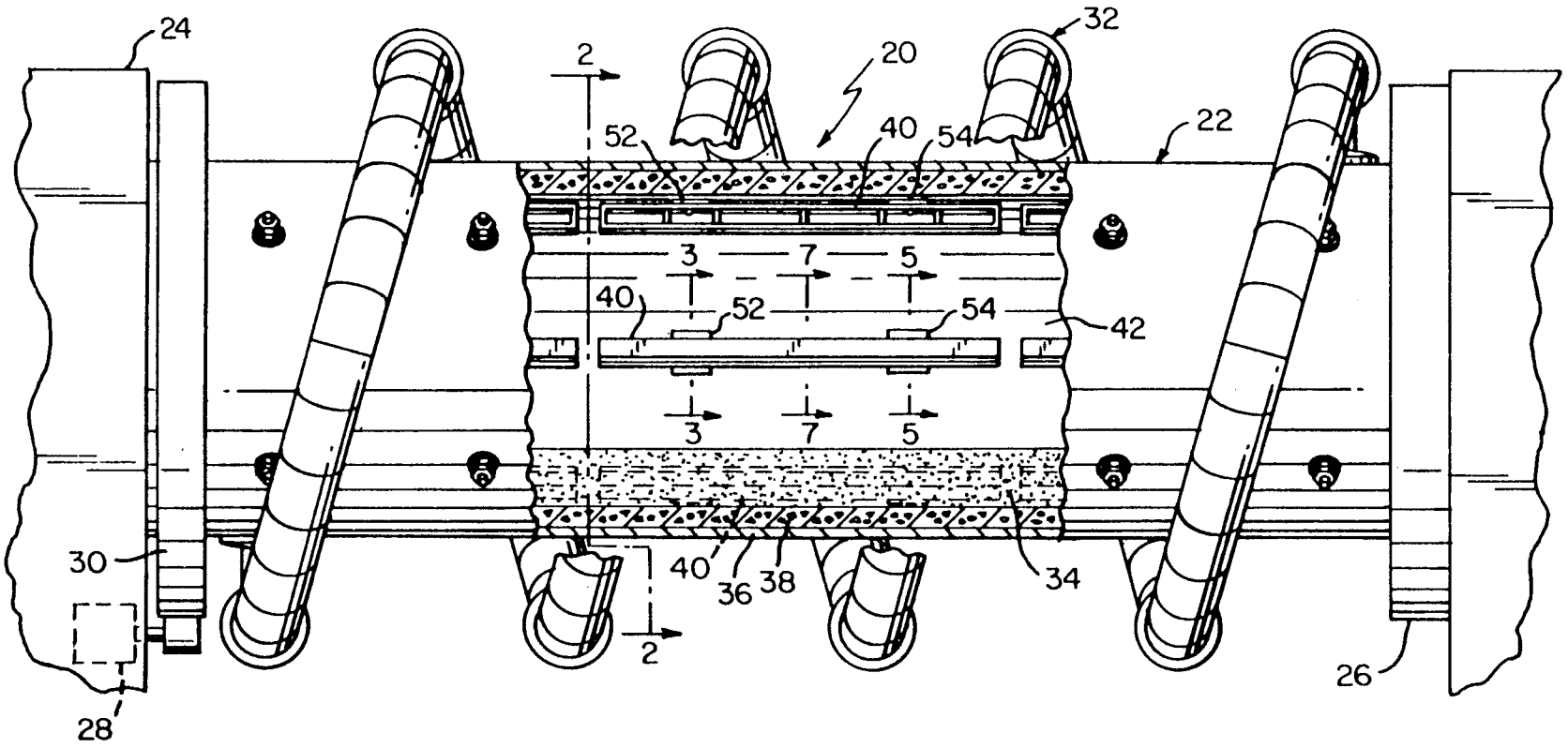
FIG. 1 is a somewhat schematic, side elevation of a reactor of the present invention, in which the reactor wall is partially broken away to reveal the interior chamber.

As shown in FIG. 1, the rotary reactor of the present invention, generally designated 20, includes a cylindrical, horizontally-oriented elongate chamber 22 having a feed end 24 and an ash and stack gas chamber at an outlet end 26. The chamber 22 is supported at its ends and is rotated by an electric motor 28 which drives a ring gear 30 attached to the chamber. Suitable controls (not shown) actuate the motor and control its speed to rotate the chamber 22 at a predetermined rate. The chamber 22 includes a helical recycle tube 32 which recirculates a particulate inorganic material such as sand 34 from the ash and stack gas chamber end 24 to the feed end 26, as the chamber 22 rotates.

The chamber 22 itself comprises a welded steel shell 36 and a refractory lining 38 extending about its inter periphery. The reactor 20 as thus far described is typical of reactors known in the art.

Figure 2:
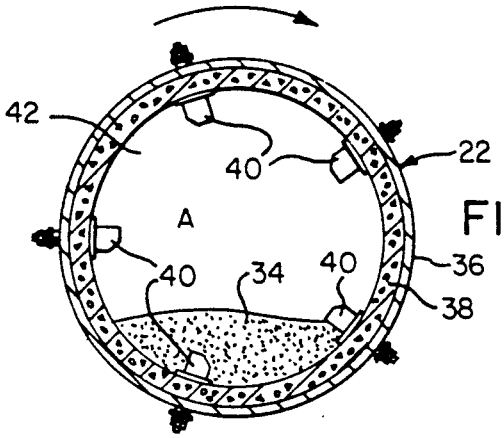
FIG. 2 is a detail end elevation of the reactor of the present invention, taken at line 2—2 of FIG. 1.

As shown in FIGS. 1 and 2, a plurality of trough-like lifters 40 are attached to the refractory lining 38 of the chamber 22 and are spaced evenly about its interior 42. Although six lifters 40 are shown, it is preferable to have 12 lifters spaced evenly about the interior of the chamber 22. Each lifter 40 is oriented substantially parallel to a central rotational axis A of the reactor chamber 22 and comprises an elongate channel having an angled outer wall 44, bottom wall 46, inner wall 48 and stiffening gussets 50 (see FIGS. 3 and 4). These components preferably are made of a heat and corrosion resistant material such as 253 MA stainless steel. The walls 44, 46, 48 are unitary and the lifter 40 is fabricated as a single channel.

As shown in FIG. 1, each lifter 40 is mounted on the chamber 22 by two mounting assemblies, generally designated 52, 54. The lifter 40 and its associated mounting assemblies 52, 54 collectively are considered the "lifter assembly."

Figure 3:
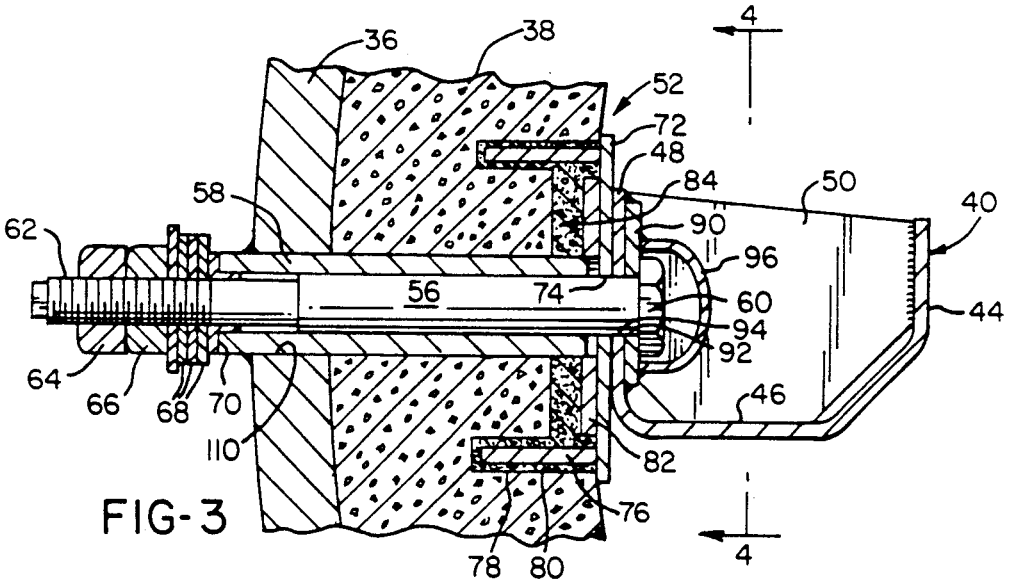
FIG. 3 is a detail showing a lifter assembly, taken at line 3—3 of FIG. 1.
Figure 4:
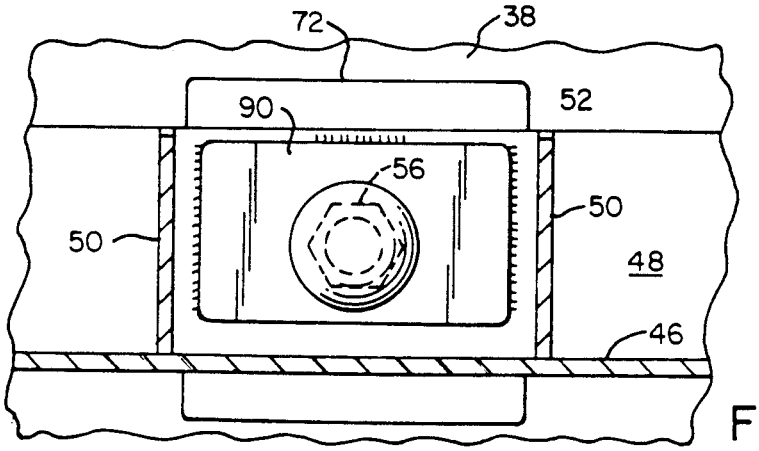
FIG. 4 is a view of the lifter assembly taken at line 4—4 of FIG. 3.

As shown in FIGS. 3 and 4, mounting assembly 52 comprises a bolt 56 received within a cylindrical sleeve 58 and including a head 60 which clamps the lifter against the chamber 22. The bolt 56 and sleeve 58 preferably are fabricated of RA-85 H or 253-MA stainless steel. The bolt 56 includes a threaded end 62 on which are mounted locking nuts 64, 66 and sets of dished springs 68 that produce a clamping force as the bolt elongates from thermal expansion. The dished springs 68 are seated on a bushing 69 which fits into the sleeve 58 and are captured by a plate washer 70 held in place by the locking nuts 64, 66. As will be discussed later in greater detail, both the bolt 56 and sleeve 58 pass entirely through the refractory lining 38 and chamber shell 36. Sleeve 58 protrudes radially outwardly from the lining 38 and is attached thereto by welding.

The lifter 40 abuts a rectangular mounting plate 72 having a central orifice 74 through which the bolt 56 extends in a rotating but not sliding fit. The mounting plate 72 is supported by a cylindrical split ring 76 (see also FIG. 9) which in turn is set within an annular recess 78 formed in the refractory lining 38 and secured therein by a bedding refractory 80. The mounting plate 72 is supported by the split ring 76 but is not rigidly attached thereto; this allows for thermal expansion and contraction of the plate and ring relative to each other. The mounting plate 72 preferably is fabricated of Haynes 556 stainless steel. The split ring 76 is preferably made of 310 stainless steel and comprises a section of schedule 40 pipe.

Figure 11:
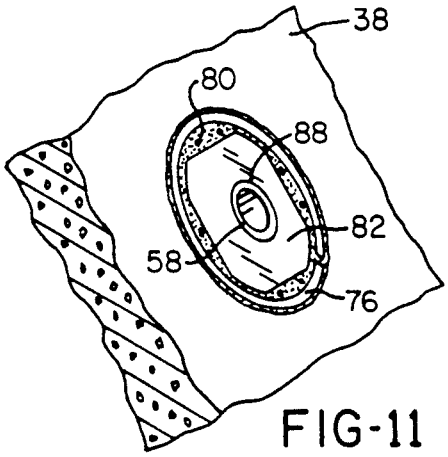
FIG. 11 shows the detail of FIG. 10 in which the centering plate has been added.
Figure 12:
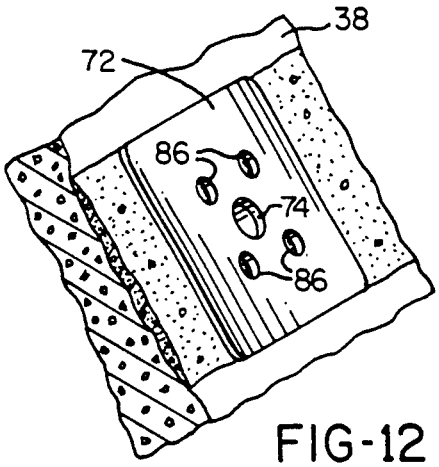
FIG. 12 shows the detail of FIG. 11 in which the mounting plate has been attached to the centering plate.

The mounting plate 72 is welded to an anchor plate 82 (see FIGS. 11 and 12). Anchor plate 82 is generally rectangular in shape with rounded corners shaped to abut the inter periphery of the split ring 76. The anchor plate 82 is set within a central recess 84 within the annular recess 78 (see FIG. 3) and is secured therein by bedding refractory 80 so that it is coplanar with the outer edge of the split ring 76 which abutts the mounting plate 72. The anchor plate 82 preferably is made of Haynes 556 stainless steel.

As shown in FIG. 12, mounting plate 72 includes four holes 86, in addition to central orifice 72, sized to receive weldments (not shown) attaching the mounting plate 72 to the anchor plate 82. Anchor plate 82 includes a central orifice 88 shaped to receive the inner end of the sleeve 58. The end of the sleeve 58 is recessed below the outer face of the anchor plate 82 (see FIGS. 3 and 5) so that when the sleeve extends in length from thermal expansion, it does not contact the mounting plate 72.

As shown in FIGS. 3 and 4, a retainer plate 90 is welded to the outer surface of the inner wall 48 and includes a central orifice 92 through which extends the shank of the bolt 56. The bolt head 60 cams against the outer surface of the retainer plate 90. Orifice 92 is in registry with orifice 94 formed in the lifter 40 through which the bolt 56 extends. The retainer plate 90 preferably is made from RA-253 MA stainless steel.

A cap 96, preferably made of 310 stainless steel, totally encloses the bolt head 60 and is welded to the retainer plate 90. Cap 96 protects the bolt head 60 from the corrosive environment within the reactor chamber 22, and from being worn away by contact with the sand 34 carried within the lifter 40. Similarly, the retainer plate 90 bears the torsional stresses imposed by operation of the reactor 20 on the connection between the bolt 56 and lifter 40. Furthermore, the flush engagement of the lifter inner wall 48 and mounting plate 72 provides a fit which minimizes the entry of contaminants and other abrasive particles between the lifter and refractory 38.

Figure 5:
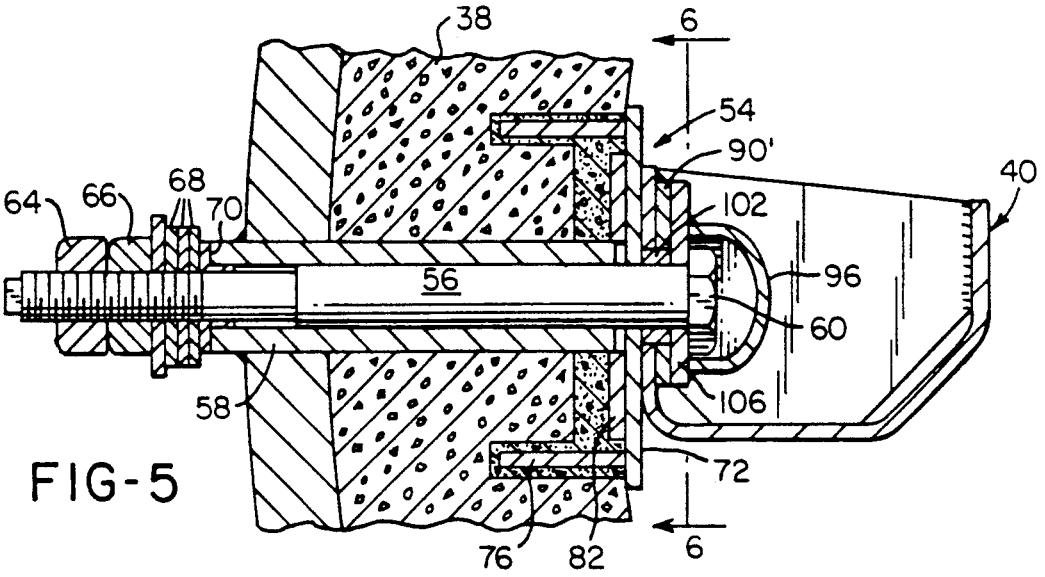
FIG. 5 is a detail fo a lifter assembly taken at line 5—5 of FIG. 1.
Figure 6:
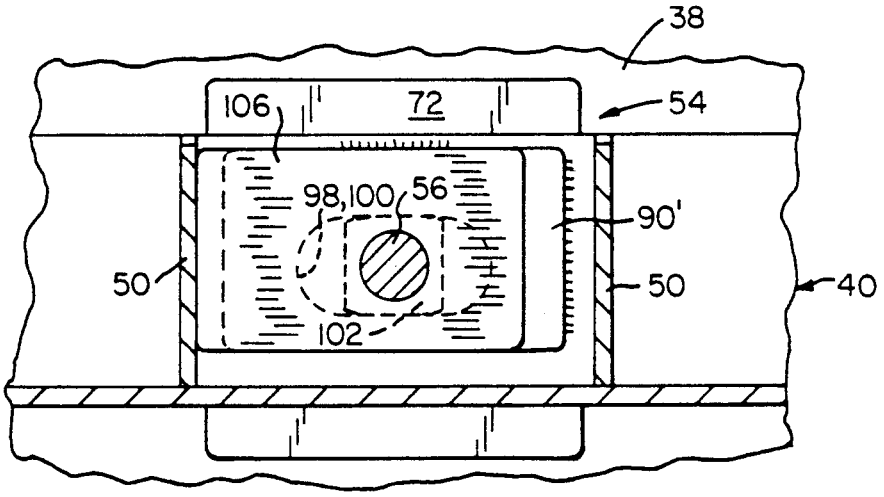
FIG. 6 is a detail fo the lifter assembly taken at line 6—6 of FIG. 5.
Figure 14:
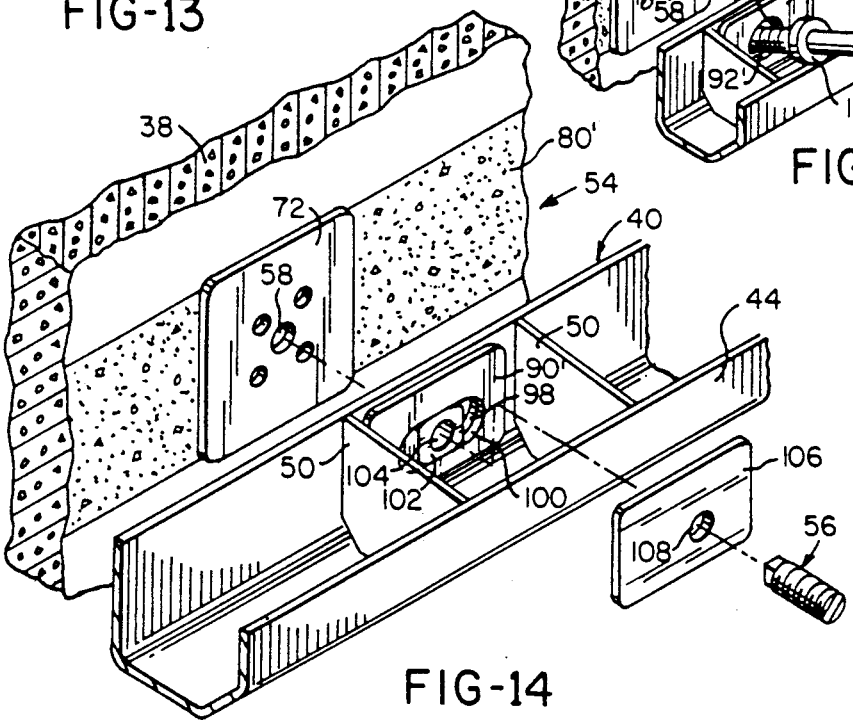
FIG. 14 is the detail of FIG. 12 in which the lifter assembly of FIG. 5 is used to attach the lifter.

As shown in FIGS. 5, 6 and 14, mounting assembly 54 is similar to mounting assembly 52, but allows for relative movement between the lifter 40 and bolt 56 caused by thermal expansion and contraction during use of reactor 20. Mounting assembly 54 is identical to mounting assembly 52 with respect to the bolt 56, sleeve 58, nuts and washers 64–70, split ring 76, mounting plate 72 and centering plate 82. However, as best shown in FIG. 14, the lifter 40 and retainer plate 90' include elongate slots 98, 100, respectively, which receive a cam plate 102. Cam plate 102, preferably made of RA-253 MA stainless steel, is slidable within the slots 98, 100 and includes a central orifice 104 sized to receive the bolt 56 therethrough.

A slide plate 106 includes a central orifice 108 which receives the bolt 56 therethrough and is shaped to cover the slots 98, 100 throughout the full range of movement of the slots relative to the bolt 56. The slide plate preferably is made of RA-253 MA stainless steel. As with mounting assembly 52, a cap 96 encloses and protects the bolt head 60, but with mounting assembly 54, the cap is welded to the slide plate 106. In embodiments of the invention in which a lifter is secured by more than two assemblies, each additional assembly is of the design shown in FIGS. 5 and 6.

Figure 7:
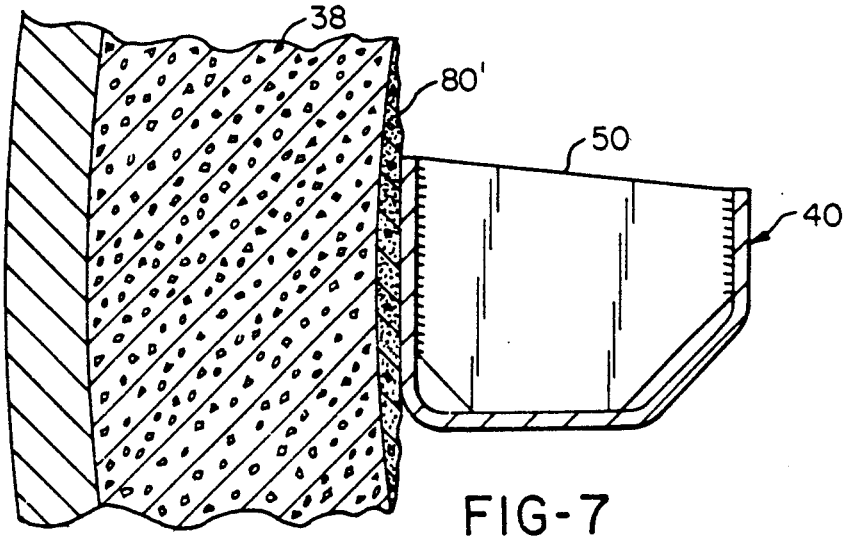
FIG. 7 is a detail of a typical lifter taken at line 7—7 of FIG. 1.

In order to minimize the collection of contaminants between the lifter 40 and refractory lining 38, a seal must be effected along the entire length of the lifter. As shown in FIG. 7, those portions of the lifter 40 which are not abutting mounting plates 72 are embedded in bedding refractory 80.

Figure 8:
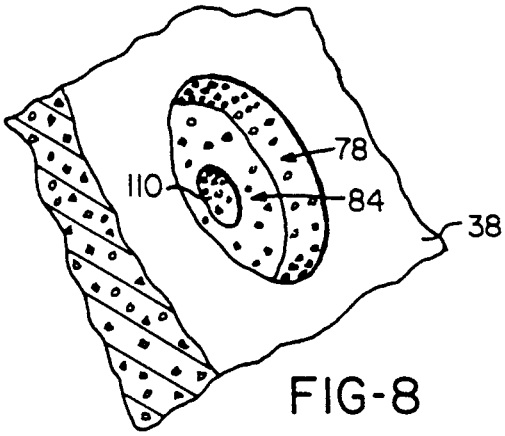
FIG. 8 is a detail of the reactor of FIG. 1 showing the recess of formed in the refractory wall for receiving the lifter assembly.

The assembly of the mounting assemblies 52, 54, with reference to FIGS. 8–12. As shown in FIG. 8, initially a central bore 110 is drilled through the refractory 38 and shell 36 (see FIG. 3). The bore 110 is formed so that it extends along a radius of the chamber 22. Next, an annular recess 78 is formed which is coaxial with the bore 110. A portion of the central area of the annular recess is removed to form the central recess 84.

Figure 9:
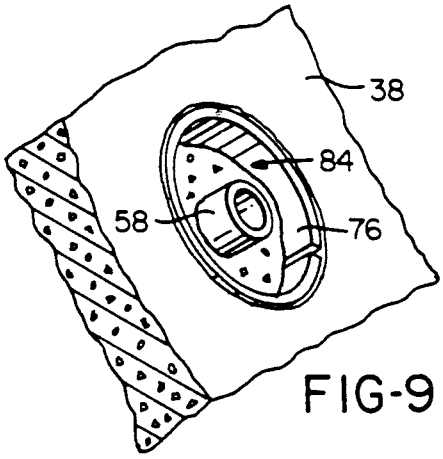
FIG. 9 shows the detail of FIG. 8 in which the sleeve and support cylinder have been mounted in the recess.
Figure 10:
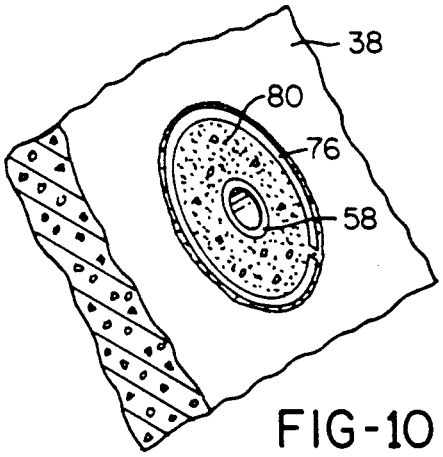
FIG. 10 shows the detail of FIG. 9 in which bedding refractory has been added to the recess.

As shown in FIG. 9, the split ring 76 is placed within the annular recess 78 and the sleeve 58 is forced into the central bore 110. Care must be taken so that the sleeve 58 and ring 76 are coaxial. The ring 76 is then set in place by bedding refractory 80.

The anchor plate 82 is pressed into the bedding refractory 80 and is fitted over the protruding end of the sleeve 58. The outer end of the split ring 76, anchor plate 82 and outer end of sleeve 58 are oriented such that all are flush with each other. Next, mounting plate 72 is positioned such the central orifice 74 is in registry with the central passage of sleeve 58, and weldments are placed in holes 86 to attach it to centering plate 82. This step is preferably performed after the bedding refractory has set up and fixed centering plate 82 relative to the refractory lining 38.

Figure 13:
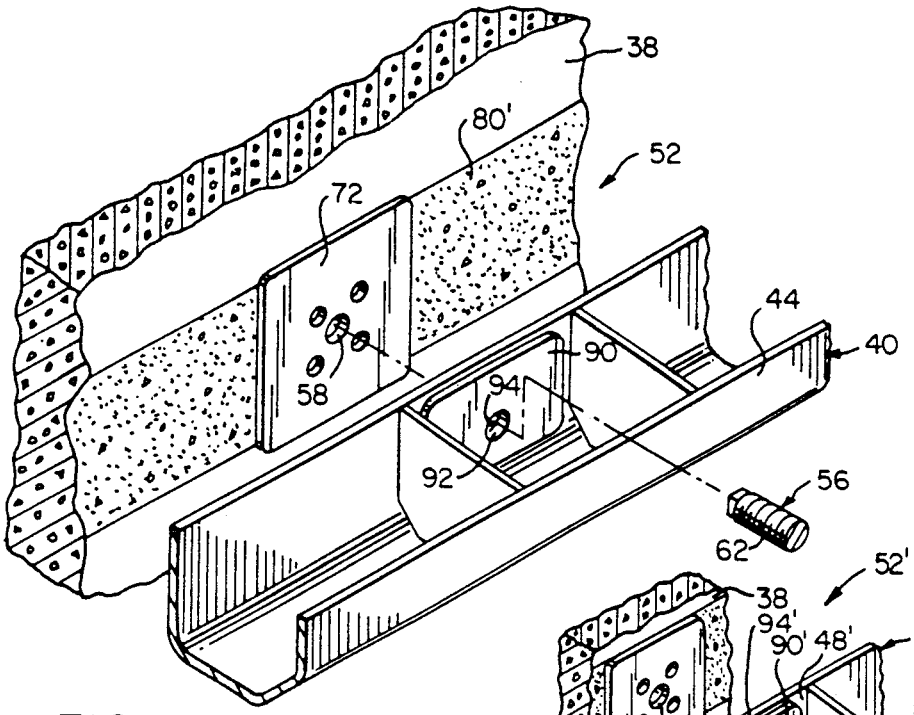
FIG. 13 shows the detail of FIG. 12 in which the lifter assembly of FIG. 3 is utilized to attach the lifter.

As shown in FIG. 13, when mounting assembly 52 is utilized, the bolt 56 is inserted through orifice 92 in retainer plate 90 and through lifter orifice 94 to sleeve 58 so that the threaded end 62 protrudes from the shell 36 and is secured by the bolts and washers (not shown). Prior to attaching the lifter 40 to the refractory liner 38, the bedding refractory 80' is placed in position so that tightening down on the bolt 56 causes the still plastic refractory 80' to form a continuous seal along the length of the lifter 40. In the final step, the cap 96 (see FIG. 3) is attached to the retainer plate 90.

As shown in FIG. 14, attaching the lifter 40 with the mounting assembly 52 is similar to that described with reference to FIG. 13, except that the bolt 56 is inserted through slide plate 106 and cam plate 104 before it enters sleeve 58. Once the bolt 56 is tightened to clamp the head 60 against the slide plate 106, the cap 96 (see FIG. 5) may be attached.

For the embodiment shown in FIGS. 13 and 14, it may be necessary to temporarily cut sections from the lifter outer wall 44 opposite the bolt 56 to enable the bolts to be inserted into the sleeves 58 through the orifices 92, 94. These sections can then be reattached by welding.

Figure 15:
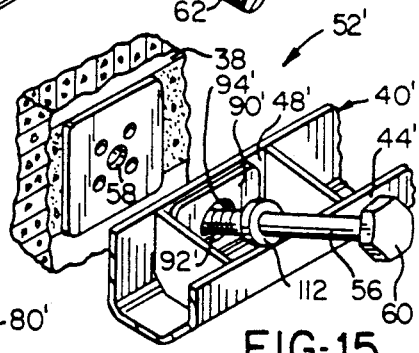
FIG. 15 is a detail of an alternate, preferred embodiment of the lifter assembly of FIG. 13.

FIG. 15 shows an alternate embodiment of the mounting assembly 52' of the invention. Retainer plate 90' and lifter inner wall 48' include enlarged, circular orifices 92', 94', respectively, and bolt 56 is fitted with an annular spacer 112. Spacer 112 is shaped to fit within orifices 92', 94' in a snug fit. The larger orifices 92', 94' enable the bolt 56 to be inserted into the sleeve 58 by passing it over the outer wall 44' of the lifter 40'.

The bolt head 60 clamps against the retainer plate 90' since it is larger in diameter than the orifice 92'. The spacer 112 prevents relative movement between the lifter 40' and the bolt 56; hence there is no relative movement between the lifter and the refractory lining 38. Accordingly, there is no need to cut the outer wall 44' to effect attachment of the mounting assembly 52'.

When the reactor 20 is in operation, the chamber rotates in the direction indicated by the arrow in FIG. 2, bringing successive ones of the lifters 40 into contact with the sand 34 in the bottom of the chamber 22. As the lifters are rotated upwardly from the bottom of the chamber 22, they carry sand which is dumped as the lifters are rotated past the topmost part of the reactor so that the sand is heated by the burners within the reactor and intermixes with the material within the chamber to be burned. The mounting assemblies 52, 54 are entirely sealed from the sand 34 so that the bolt 56 is not damaged or abraded by contact with the sand.

When a lifter 40 becomes worn or damaged, it is a relatively simple matter to cut off the cap 96, remove the bolt 56 from sleeve 58 and remove the damaged lifter from the chamber 22. Reattachment of a new or repaired lifter 40 can be accomplished quickly and with little difficulty as well.

While the form of apparatus herein described constitutes a preferred embodiment of this invention, it is to be understood that the invention is not limited to this precise form of apparatus, and that changes may be made therein without departing from the scope of invention.

What is claimed is:

1. In a rotary reactor of a type having a substantially cylindrical, horizontally-oriented, elongate chamber for burning materials therein, said chamber including and interior surface lined with a refractory, means for rotating said chamber, and lifter means, extending along said interior surface for lifting sand in a lower portion of said chamber to an upper portion thereof as said chamber rotates, gradually dumping sand lifted thereby from said upper portion, a lifter assembly comprising:

bolt means extending through said refractory for attaching said lifter means to said chamber;

mounting plate means, positioned beneath said lifter means, for receiving said bolt means therethrough and being attachable to said refractory independently of said bolt means, seating said lifter means against said refractory, whereby entry of sand and other particulates between said channel means and said refractory is minimized;

a retainer plate clamped by said bolt means against said lifter means; and said lifter means and said retainer plates both including slots extending in a lengthwise dimension of said lifter means, said slots being substantially in registry with each other and receiving said bolt means therethrough, said slots being sized to allow a thermal expansion of said lifter means relative to said refractory.

2. The reactor of claim 1 further comprising a cam plate receiving said bolt means therethrough, said cam plate being positioned within said slots and being slidable relative thereto.

3. The reactor of claim 2 further comprising a slide plate receiving said bolt means therethrough, said slide plate being superposed to said retainer plate and sized to cover said slots throughout a full range of movement of said lifter means and said retainer plate relative to said bolt means and said refractory as a result of thermal expansion of said lifter means.

4. In a rotary reactor of the type having a substantially cylindrical, horizontally-oriented, elongate chamber for burning materials therein, said chamber including an interior surface lined with a refractory, means for rotating said chamber, and lifter means, extending along said interior surface, for lifting sand in a lower portion of said chamber to an upper portion thereof as said chamber rotates, gradually dumping sand lifted thereby from said upper portion, a lifter assembly comprising:

bolt means for attaching said lifter means to said chamber; and mounting plate means associated with said bolt means and attachable to said refractory independently of said bolt means, for seating said lifter means against said refractory whereby entry of sand and other particulates between said after means and said refractory is minimized, said mounting plate means including a mounting plate positioned normal to said bolt means and adjacent to one of said lifter means and support cylinder means, recessed into said refractory, for supporting said mounting plate.

5. The reactor of claim 4 wherein said support means includes a split support cylinder, coaxial with said bolt means.

6. The reactor of claim 5 wherein said mounting plate means includes sleeve means for receiving said bolt means therethrough, said sleeve means being concentric with said support cylinder means and extending through said chamber and said refractory.

7. The reactor of claim 6 wherein said sleeve means includes a sleeve member associated with said support cylinder.

8. The reactor of claim 7 further comprising means for attaching said mounting plate to said refractory relative to said support cylinder.

9. The reactor of claim 8 wherein said attaching means comprises an anchor plate oriented normal to, and having a central orifice for receiving said sleeve member therethrough, and having an outer periphery contiguous to an inner periphery of said support cylinder; said mounting plate being attached to said anchor plate.

10. The reactor of claim 4 further comprising a retainer plate clamped by said bolt means against said lifter means.

11. The reactor of claim 10 wherein said lifter means and said retainer plate include orifices larger in diameter than said bolt to allow insertion of said bolt into an orifice in said chamber; and annular spacer means, carried on said bolt, sized to fit within said orifices and substantially eliminate relative movement between said lifter and said bolt.

12. The reactor of claim 10 wherein said lifter means and said retainer plate both include slots extending in a lengthwise dimension of said lifter being substantially in registry with each other and receiving said bolt means therethrough, said slots being sized to allow thermal expansion of said lifter means.

13. The reactor of claim 12 further comprising a cam plate receiving said bolt means therethrough, said cam plate being positioned within said slots and being slidable relative thereto.

14. The reactor of claim 13 further comprising a slide plate receiving said bolt means therethrough, said slide plate being superposed to said retainer plate and sized to cover said slots throughout a full range of movement of said lifter means and said retainer plate relative to said bolt means.

15. The reactor of claim 14 further comprising a cap enclosing an end of said bolt means and being attached to said slide plate.

16. The reactor of claim 10 further comprising a cap enclosing an end of said bolt means and being attached to said retainer plate.

17. The reactor of claim 10 wherein said retainer plate is attached to said lifter means.

18. The reactor of claim 9 wherein said support cylinder is positioned within a recess formed in said refractory lining, and is secured therein by bedding refractory.

19. The reactor of claim 18 wherein said centering plate is secured within said support cylinder by said bedding refractory.

20. The reactor of claim 18 wherein said mounting plate means is mounted within said bedding refractory and is retained therein by said bedding refractory.

21. The reactor of claim 4 further comprising bedding refractory, positioned between said lifter means and said refractory and shaped to provide a foundation for said lifter means whereby sand and other contaminants are prevented from lodging between said lifter means and said refractory.

22. In a rotary reactor of the type having a substantially cylindrical, horizontally-oriented, elongated chamber for burning materials therein, said chamber including an interior surface lined with a refractory, means for rotating said chamber, and lifter means, extending along said interior surface, for lifting sand in a lower portion of said chamber to an upper portion thereof as said chamber rotates, gradually dumping sand lifted thereby from said upper portion, a lifter assembly comprising:

bolt means for attaching said lifter means to said chamber;

a split support cylinder recessed into said refractory lining and retained therein by bedding refractory, said cylinder being coaxial with said bolt means;

a sleeve member extending through said chamber and said refractory and receiving said bolt means therethrough, said sleeve member being coaxial with said support cylinder;

an anchor plate oriented normal to and receiving said bolt means and said sleeve member therethrough, said anchor plate having an outer periphery substantially contiguous with an inner periphery of said sleeve member and being retained therein by bedding refractory;

a mounting plate supported on said support cylinder and attached to said anchor plate, said mounting plate receiving said bolt means therethrough, said bolt means clamping said lifter means against said mounting plate, whereby an abutting relation is formed between said mounting plate and said lifter means which minimizes entry of contaminants therebetween;

a retainer plate, attached to an inner surface of said lifter means and receiving said bolt means therethrough such that said bolt means cams against said retainer plate to clamp said lifter means against said mounting plate; and cap means positioned within said lifter means for enclosing and protecting an end of said bolt means.

23. The reactor of claim 22 wherein said retainer plate and a contiguous wall of said lifter means include slots substantially coextensive with each other for receiving said bolt means therethrough, whereby said lifter means is enabled to move relative to said bolt means as a result of thermal expansion.

24. The reactor of claim 22 further comprising a cam plate slidably mounted within said slots and receiving said bolt means therethrough; and a slide plate receiving said bolt means therethrough and shaped to cover said slots such that contaminants are prevented from entering said slots.

25. The reactor of claim 23 wherein said cap means is attached to said slide plate.

26. The reactor of claim 23 wherein said cap means is attached to said retainer plate.

* * * * *